United States Patent [19]

Fougeron et al.

[11] Patent Number: 4,849,184

[45] Date of Patent: Jul. 18, 1989

[54] APPARATUS FOR TREATMENT OF RADIOACTIVE LIQUID

[75] Inventors: Charles Fougeron, Versailles; Jean J. Fidon; Herve Janiaut, both of Paris, all of France

[73] Assignee: Somafer S.A., Fameck, France

[21] Appl. No.: 169,464

[22] Filed: Mar. 17, 1988

Related U.S. Application Data

[62] Division of Ser. No. 914,987, Oct. 3, 1986, Pat. No. 4,762,646.

[30] Foreign Application Priority Data

Oct. 4, 1985 [FR] France ..... 85 15150

[51] Int. Cl.[4] ..... G21P 9/16; F23G 7/00; F23G 7/04; F26B 7/00

[52] U.S. Cl. ..... 422/159; 110/215; 110/237; 110/238; 110/342; 110/348; 110/240; 110/241; 110/216; 159/4.4; 159/47.3; 159/DIG. 12; 159/48.1; 252/628; 252/631; 252/632; 219/201; 422/903

[58] Field of Search ..... 252/628, 631; 110/215, 110/216, 237, 346, 238, 214, 342, 210, 348, 212; 159/DIG. 12, 47.3, 6.2, 4.4, 48.1; 422/159

[56] References Cited

U.S. PATENT DOCUMENTS

| | | | |
|---|---|---|---|
| 3,101,258 | 8/1963 | Johnson | 252/632 |
| 4,056,362 | 11/1977 | Gablin et al. | 252/628 |
| 4,203,863 | 5/1980 | Knotik et al. | 159/DIG. 12 |
| 4,274,962 | 6/1981 | Queiser et al. | 252/632 |
| 4,305,780 | 12/1981 | Black | 252/632 |
| 4,334,953 | 6/1982 | Sridhar | 159/DIG. 12 |
| 4,383,888 | 5/1983 | Chino et al. | 159/49 |
| 4,476,048 | 10/1984 | Ambros et al. | 252/632 |
| 4,499,833 | 2/1985 | Grantham | 110/342 |
| 4,526,713 | 7/1985 | Chino et al. | 252/632 |
| 4,579,069 | 4/1986 | Gay et al. | 110/342 |

*Primary Examiner*—Howard J. Locker
*Attorney, Agent, or Firm*—Nixon & Vanderhye

[57] ABSTRACT

The pH of low level radioactive waste liquid is adjusted to be substantially neutral and the liquid is passed to apparatus comprising an atomizer (11) having a turbine (15), air being heated by an electric heater (16) to the atomizer (11) to provide low level radioactive waste particles which may be encapsulated, e.g. in a resin. The apparatus may be transportable, and is claimed per se.

6 Claims, 2 Drawing Sheets

APPARATUS FOR TREATMENT OF RADIOACTIVE LIQUID

This application is a divisional application of Ser. No. 06/ 914,987, filed Oct. 3, 1986, now U.S. Pat. No. 4,762,646.

The invention relates to a method of treating low level radioactive waste liquid, and in particular liquid effluents containing beta or gamma low level radioactive substances to convert them into storable solids.

One of the major problems of the nuclear industry is the storage of radioactive waste and principally liquid effluents. It is necessary to treat liquid effluents to convert them into a stable product of minimal volume.

Several solutions have been proposed, amongst which can be cited those which consist of diluting and neutralising the effluent and precipitating metallic hydroxides. It is also known to evaporate part of the water to form sludge which is separated by centrifuging and which is then enclosed in bitumen or cement or subjected to incineration. These processes can only be performed in specialized treatment centres.

U.S. Pat. No. 4,065,400 teaches a method in which the atomized liquid waste is introduced into a fluidized bed of inert and hot particles, and removed after calcination with a part of the bed for subsequent vitrification.

British Patent No. A-2046499 teaches a method in which the radioactive elements of the liquid effluents are fixed on ion-exchanging resins which are then encapsulated in an organic material before being placed on the sea bed. These methods require cumbersome installations which cannot be used at every site, and are not movable. Also, to obtain a dry product which can be encapsulated, these solutions require the introduction of an extra substance which increases the volume to be stored.

It is known from European patent publication -A-0125381 (Rockwell) to reduce the volume of low level radioactive wastes containing free water by converting the waste into the form of an atomised spray and contacting the spray with hot gases to form a dry flowable powder and water vapour. The powder is then incorporated in a matrix for storage. The method is performed in a carbon steel vessel at a fixed installation and the gases are heated by burning a fuel. The method is not efficient because radioactive contamination is likely to build up in the vessel and unless extra precautions are taken the fuel will cause pollution. It is one object of this invention to provide a substantially pollution free method of treating low level radioactive waste liquid such that the apparatus in which the method is performed will be of long and safe life, and which will provide solids better adapted to a prolonged storage life. It is a further object to provide apparatus for performing the method which is transportable.

According to one aspect of the invention there is provided a method of treating low level radioactive waste liquid, comprising atomising the liquid to provide particles of solid radioactive material and then encapsulating the particles in a matrix characterised in that the pH of the liquid is adjusted to be substantially neutral before the liquid is subjected to atomisation.

The adjustment of the pH of the liquid has the effect of ensuring that when the liquid is atomised the solids formed do not tend to crystallise in the apparatus in which the method is performed. Such deposits can form on the inner wall surfaces of the atomiser and in the associated pipes which can become corroded and even blocked. In addition, because the radioactive particles have a neutral pH, when they are later encapsulated in a matrix e.g. one of resin, concrete or bitumen, there is reduced tendency for a chemical attack or instability.

Preferably the pH of the liquid is adjusted to a value of between about 6 and about 8, most preferably about 6.7. While a variety of neutralising agents can be used to adjust the pH, it is preferred that a strong caustic solution is used to adjust the pH of the liquid; most preferably the strong caustic solution is potash. Neutralisation is preferably carried out by agitation and with cooling, so that the aerosol formation temperature is not reached.

The neutralised liquid, which may be a suspension, is then supplied to a centrifugal wheel atomiser and typically to the turbine of the atomiser dryer which is preferably inside and at the top of a cylindro-conically shaped chamber. Preferably the speed of rotation of the turbine is between about 18,000 and about 24,000 revolutions/minute in order to form a mist of fine droplets into which heated air is injected to bring about an instantaneous evaporation of the liquid and to form dry particles which do not agglomerate together and do not adhere to the walls of the chamber. These particles are removed at the bottom of the cone of the chamber by the flow of hot air. The air is preferably heated by non-polluting means, preferably an electric heater, and most preferably to about 400° C. to about 500° C.

The rate of supply of the air and the output are regulated so as to have a temperature of between about 105° C. and about 150° C. at the atomiser outlet.

The formed mixture of air, particles and water vapour is then conveyed over a pre-filter, then over a filter, and finally over a final filter, so that the gaseous flow is completely free from any contamination and can be returned to the atmosphere.

The dry particles recovered in the filters are then mixed with an encapsulating agent, preferably a thermo-hardenable plastics material and the mixture is placed in packings of plastics material in which is created a vacuum of between about 200 and about 400 Pa and heating is carried out at between about 110° C. and about 150° C. so as to make the plastic material flow. These packings are then placed in casks to be stored or buried, in the usual way.

The thermo-hardenable plastics material is preferably a low-density polyethylene but for certain products containing particularly emissive radioactive contaminants, resins concrete or bitumen can be used. The packings are preferably of polyethylene.

The method of the invention thus makes possible the total treatment of a liquid effluent contaminated by beta or gamma radiation to provide a solid product which complies with the standard fixed by ANDRA.

This method comprises a succession of fully integrated steps without any discontinuity, and the product comprises a mass having an extremely reduced volume. This mass is chemically inert, has suitable mechanical characteristics and toxic matter was not released when lixiviation tests are carried out, nor are any sweating phenomena observed.

The invention is applicable to liquid effluents containing any source of low level radioactivity and is particularly applicable to low level radioactive waste containing beta and gamma emitters. The level of radiation is typically below $4\times10^{-1}$G.Bq.m$^{-3}$.

In another aspect the invention provides apparatus for use in the treatment of low level radioactive waste liquid comprising a vessel to receive the liquid and supply it to an atomiser, means for supplying heated air to the atomiser and filtration means for separating the solid particles and water vapour characterised in that means are present to adjust the pH of the liquid before it is supplied to the atomiser.

Preferably the inner walls of the apparatus are formed of stainless steel. Preferably the atomiser includes a turbine which is arranged to rotate at a speed of between about 18000 to about 24000 revolutions/minute to form droplets which are atomised by heated air. Most preferably the heated air supplied to the atomiser is heated by an electric heater.

In a much preferred feature of the invention, the apparatus is mounted on a transporter so that it may be moved to a supply of liquid to be treated. For this purpose, the transporter is encased in a radiation proof shield.

In order that the invention may well be understood it will now be described with reference to the drawings, in which.

Figure 1:
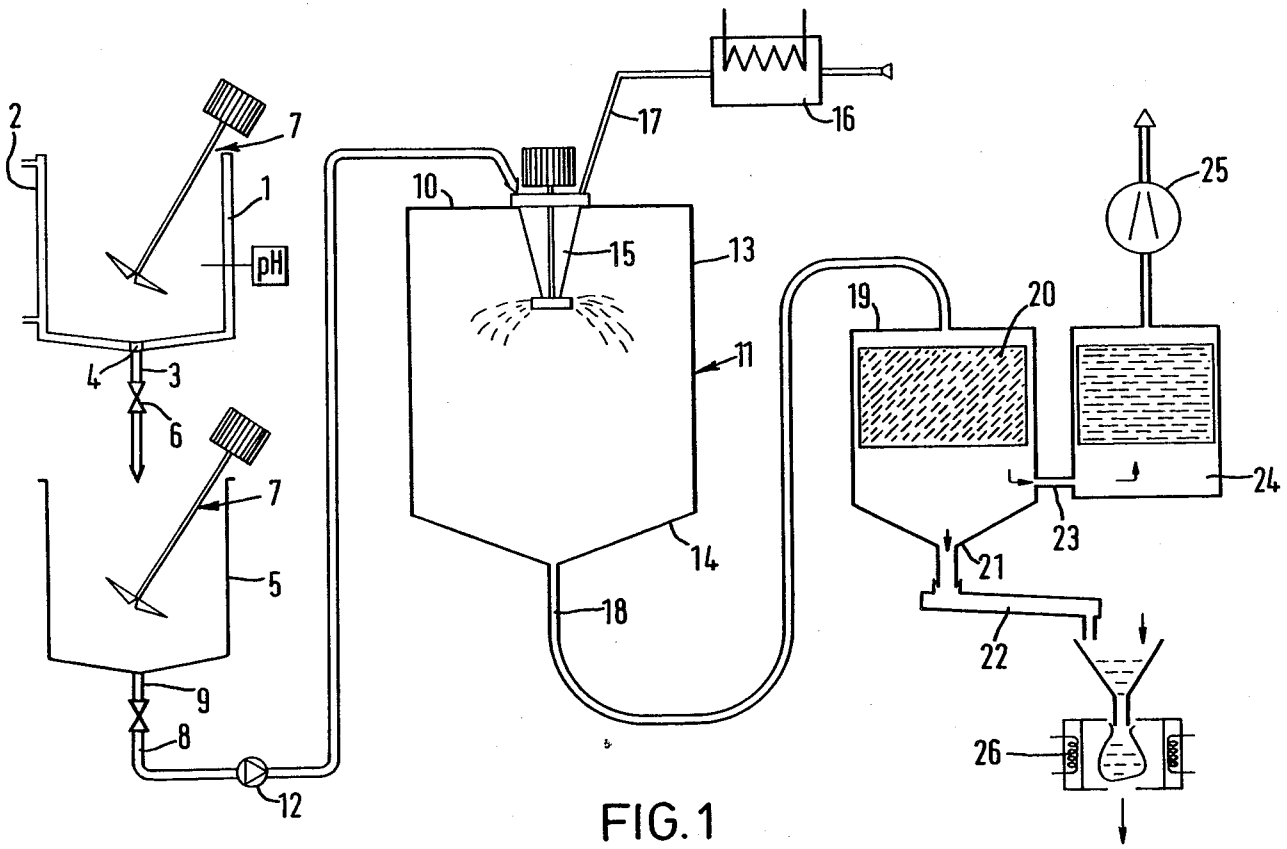
FIG. 1 is a schematic diagram of apparatus of the invention.

The apparatus of FIG. 1 comprises a number of vessels all formed of or provided with an inner wall of stainless steel such an INOX 314 or 316. A receiving vessel 1 has a hollow wall 2 to receive and circulate coolant liquid such as water. A pipe 3 connects the outlet 4 of the vessel 1 and a holding tank 5, the pipe 3 incorporating a control valve 6. Each of vessels 1 and 5 incorporates a stirring device 7. A pipe 8 leads from the outlet 9 of the tank 6 to the roof 10 of an atomiser dryer 11 of the type known as F10 or P6 available from NIRO Atomizer, France. A vacuum pump 12 is present in the pipe 8. The dryer 11 has an upper portion 13 of constant diameter and a lower portion 14 of conical shape. A rotary turbine 15 extends downwardly from the roof 10 of the dryer 11 and is arranged to rotate at a speed of about 18000 to 24000 revolutions/minute. Air is supplied to an electric heater 16 having a capacity of about 140 KW and the heated air is supplied via a pipe 17 to the dryer 11. A pipe 18 leads from the outlet of the dryer 11 to a first filter 19. The filter incorporates filter elements 20. The lower outlet 21 of the filter 19 leads to a fluidised bed 22 and a side outlet 23 leads to a second filter 24 which leads to a ventilator extractor 25. The exit end of the bed 22 leads to heat unit 26 through which pass solid particles and a thermo-hardenable resin below which is a storage area 27.

In use, low level radioactive waste liquid is introduced into the vessel 1. A neutralising agent, such as a solution of potassium hydroxide in water is added while coolant is circulated through the hollow wall 2 and the stirring device 7 is actuated. The pH of the liquid is monitored until a value of between about 6 and about 8, preferably about 6.7 is attained. The neutralised liquid is then passed to the holding tank 2. Air heated by heater 16 is passed via pipe 17 to the dryer 11. The neutralised liquid is pumped to the rotary turbine 15 which is rotated at about 18000 to 24000 r.p.m. to form droplets within the dryer 11 and the heated air atomises the droplets to form particles and water vapour which deposits as a powder on the inside wall of the dryer 11. The air then passes the powder to the filter 19 to separate water vapour from the particles which are passed over the fluidised bed 22 to the heater 26 to be encapsulated under vacuum and heat in resin. The method is simple to operate and the apparatus is not prone to corrosion. The volume of the liquid is reduced substantially to provide a satisfactory stable end product of high density and low moisture content.

Figure 2:
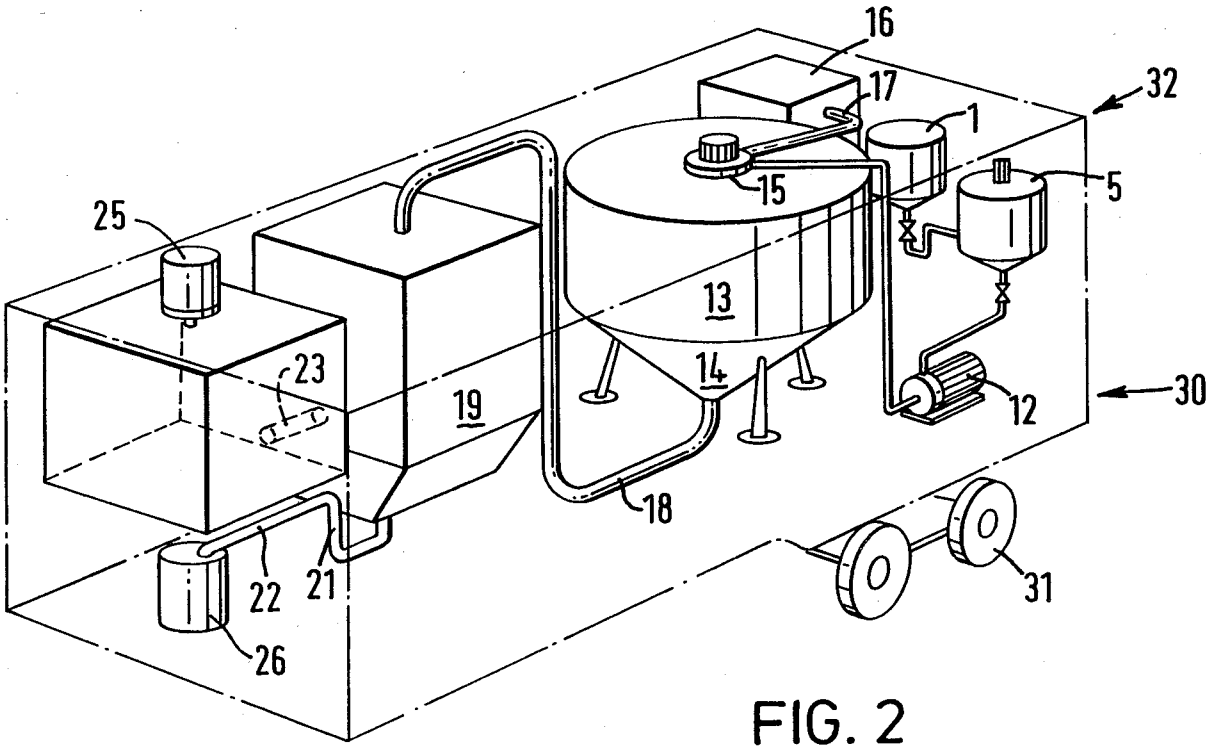
FIG. 2 is a perspective view of the apparatus of FIG. 1 mounted on a transporter.

The apparatus shown in FIG. 2 is the apparatus of FIG. 1 mounted on a trailer 30 having wheels 31. The trailer may be moved from site to site so that low level radioactive waste may be treated on site. A radiation proof shield 32 covers the exterior of the apparatus.

The invention is further illustrated with reference to the following examples.

EXAMPLE 1

Different components which had been subject to a "swimming bath" contamination were decontaminated electrolytically by reaction with a solution formed from a 50/50% by weight mixture of phosphoric acid and sulphuric acid, and then rinsed.

A suspension containing 125 g/l of $H_2SO_4$, 125 g/l of $H_3PO_4$ and 3.3 g/l of metallic ions was collected and was subjected to the process according to the invention in an installation capable of treating approximately 80 l/h of suspension. The suspension was first neutralised to a pH of 6.7 by means of a lixiviate at 450 g/l of KOH, while maintaining a temperature below 90° C. A suspension at 438 g/l total salinity was collected, this was then treated in an atomiser equipped with a turbine rotating at 18,000 r.p.m., on the inside of which circulated an output of air of 980 $m^3$/h entering at 450° C. and leaving at 110° C. The filtrate was collected off the filters, and about 35 kg/h of particles of 26 micron mean granulometry, 0.57 density and containing less than 0.05% humidity were collected. The content of gaseous waste particles was less than 0.01 mg/$Nm^3$.

These solid particles were mixed with 15 kg of low-density polyethylene of 300 micron granulometry and the mixture placed in polyethylene packings in which was created a relative vacuum of 250 Pa and which were heated to 130° C. The product to be encasked represented 50 $dm^3$.

EXAMPLE II

A solution, representative of low level radioactive waste liquid, was made up as follows:

$H_3PO_4$, 686 g/l
$H_2SO_4$, 387 g/l
Fe, 20 g/l
Cr, 4.75 g/l
Ni, 2.8 g/l 100 ml of the solution was diluted with 100 ml of water and to form a mixture which had a pH of about 0.5. The mixture was neutralised with a solution of potash (1.5 potash beads in 4 parts water) to a pH of 6.5. During the course of neutralisation a green crystalline precipitate was formed and this was kept in suspension by simple agitation.

The neutralised solution was treated using apparatus according to FIG. 1. The heated air entered in the atomiser dryer at 500° C. and exited at 120° C. The turbine was rotated at 20,000 revolutions/minute and the drying time was about 45 minutes. The dryer was opened, and a powdery deposit about 10% humidity was observed on the lower part of the dryer. After drying the moisture content fell to 3%. The sieve analysis showed that 10% of the product was below 14 micron, 50% below 41 micron and 90% below 86 micron.

EXAMPLE III

The method of example I was repeated at an inlet temperature of 425° C. and an outlet temperature of 130° C.; the speed of turbine rotation was 24,000 revolutions/minute and the drying took about 2.5 hours. The sieve analysis showed that 10% of the product was below 9 micron, 50% below 30 micron and 90% below 63 micron.

The apparatus of the invention may be cleaned out using demineralised water. Because the method of the invention provides a non corrosive form of the radioactive materials and because the inner lining of the vessels is a stainless steel, there is little or no build up of radioactive material in the apparatus so that it will have a long and safe life.

We claim:

1. Apparatus for use in the treatment of low level radioactive liquid waste, the apparatus comprising: a first vessel to receive the liquid to be treated; means for cooling the liquid received in said first vessel; means for adding a neutralising agent to the liquid in said first vessel to form a mixture; means for agitating the formed mixture; means for monitoring the pH of the formed mixture in said first vessel; a second vessel adapted to receive said mixture from said first vessel; and an atomiser connected to said second vessel, wherein means are provided for supplying heated air to the atomiser for atomising droplets of said mixture to form solid particles and water vapor; and further wherein filtration means are provided to separate the solid particles and the water vapor formed by the atomisation.

2. Apparatus according to claim 1 wherein the inner walls of said first and second vessels are formed of stainless steel.

3. Apparatus according to claim 1 wherein the atomiser includes a turbine adapted to rotate at a speed of between about 18000 to about 24000 revolutions/minute to form said droplets which are atomised by the heated air.

4. Apparatus according to claim 3 wherein the heated air supplied to the atomiser is heated by an electric heater.

5. Apparatus according to claim 1 wherein the apparatus is mounted on a transporter so that it may be moved to a supply of liquid to be treated.

6. Apparatus according to claim 5 wherein the transporter is encased in a radiation proof shield.

* * * * *